US007387112B2

(12) United States Patent
Oohashi et al.

(10) Patent No.: US 7,387,112 B2
(45) Date of Patent: Jun. 17, 2008

(54) JET PUMP, FUEL FEED APPARATUS HAVING THE SAME, AND METHOD FOR WELDING THE SAME

(75) Inventors: Masaharu Oohashi, Kariya (JP); Kenji Okabe, Hanoi (VN)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/723,186

(22) Filed: Mar. 16, 2007

(65) Prior Publication Data

US 2007/0217921 A1 Sep. 20, 2007

(30) Foreign Application Priority Data

Mar. 17, 2006 (JP) ..... 2006-074016

(51) Int. Cl.
*F04B 23/04* (2006.01)
*F02M 37/04* (2006.01)

(52) U.S. Cl. ..... 123/509; 417/79

(58) Field of Classification Search ..... 123/509; 471/79

See application file for complete search history.

(56) References Cited

U.S. PATENT DOCUMENTS

| | | | | |
|---|---|---|---|---|
| 3,729,273 | A * | 4/1973 | Shimrony | 417/79 |
| 5,218,942 | A * | 6/1993 | Coha et al. | 123/514 |
| 6,343,589 | B1 * | 2/2002 | Talaski et al. | 123/514 |
| 6,705,298 | B2 * | 3/2004 | Ramamurthy et al. | 123/509 |
| 2004/0074995 | A1 | 4/2004 | Okada | |

* cited by examiner

*Primary Examiner*—Thomas N Moulis
(74) *Attorney, Agent, or Firm*—Nixon & Vanderhye PC

(57) ABSTRACT

A jet pump is provided for supplying fuel from a fuel tank into a sub-tank, which is accommodated in the fuel tank. The jet pump includes a welded portion adapted to being welded to an outer wall surface of a bottom portion of the sub-tank. A swirl portion defines therein a swirl chamber. A jet nozzle generates negative pressure by jetting swirl-flowing fuel passing through the swirl chamber so as to draw fuel from the fuel tank into the sub-tank. A pressure-receiving portion defines a clearance with respect to the swirl portion. The pressure-receiving portion extends from the welded portion in a direction to distant from the sub-tank. The pressure-receiving portion is applied with force toward the welded portion when the welded portion is welded to the sub-tank.

16 Claims, 5 Drawing Sheets

JET PUMP, FUEL FEED APPARATUS HAVING THE SAME, AND METHOD FOR WELDING THE SAME

CROSS REFERENCE TO RELATED APPLICATIONS

This application is based on and incorporates herein by reference Japanese Patent Application No. 2006-74016 filed on Mar. 17, 2006.

FIELD OF THE INVENTION

The present invention relates to a jet pump for drawing fuel. The present invention further relates to a fuel feed apparatus having the jet pump. The present invention further relates to a method for welding the jet pump.

BACKGROUND OF THE INVENTION

Conventionally, a fuel feed apparatus includes a sub-tank accommodated in a fuel tank. The fuel feed apparatus further includes a jet pump for supplying fuel from the fuel tank into the sub-tank. Specifically, according to US 2004/0074995 A1 (JP-A-2004-156588), a jet pump supplies fuel into the sub-tank, so that the fuel level in the sub-tank can be maintained higher than the fuel level in the fuel tank, even when fuel in the fuel tank decreases. In this structure, the fuel pump accommodated in the sub-tank is capable of steadily pumping fuel from the sub-tank, even the fuel level decreases in the fuel tank.

In US 2004/0074995 A1, a jet pump is welded to the outer wall surface of the bottom portion of the sub-tank. When the jet pump is welded to the sub-tank, the jut pump may be applied with force onto the sub-tank.

Here, a jet pump is capable of generating a swirl flow to jet the swirl-flowing fuel through a jet nozzle. In this jet pump, a swirl chamber is provided in upstream of the jet nozzle for supplying swirl-flowing fuel toward the jet nozzle. In general, a cylindrical member defines the swirl chamber therein.

When the cylindrical member defining the swirl chamber is applied with force toward the sub-tank, it is difficult to steadily applying force onto the round surface of the swirl chamber. Therefore, when application of force to the cylindrical member is unstable, the cylindrical member may be tilted, and misaligned with respect to the sub-tank.

Furthermore, when the cylindrical member defining the swirl chamber is directly applied with force, the cylindrical member may be deformed, and the shape of the swirl chamber cannot be maintained.

SUMMARY OF THE INVENTION

The present invention addresses the above disadvantage. According to one aspect of the present invention, a jet pump is provided for supplying fuel from a fuel tank into a sub-tank, which is accommodated in the fuel tank. The jet pump includes a welded portion that is adapted to being welded to an outer wall surface of the sub-tank. The jet pump further includes a swirl portion that defines therein a swirl chamber. The jet pump further includes a jet nozzle for generating negative pressure by jetting swirl-flowing fuel passing through the swirl chamber so as to draw fuel from the fuel tank into the sub-tank. The jet pump further includes a pressure-receiving portion that defines a clearance with respect to the swirl portion. The pressure-receiving portion extends from the welded portion in a direction to distant from the sub-tank. The pressure-receiving portion is applied with force toward the welded portion when the welded portion is welded to the outer wall surface of the sub-tank.

According to another aspect of the present invention, a jet pump is provided for supplying fuel from a fuel tank, which accommodates a sub-tank, into the sub-tank. The jet pump includes a welded portion that is adapted to being welded to an outer wall surface of the sub-tank. The jet pump further includes a swirl portion that defines a swirl chamber. The jet pump further includes a jet nozzle for generating negative pressure by jetting swirl-flowing fuel passing through the swirl chamber so as to draw fuel from the fuel tank into the sub-tank. The jet pump further includes a pressure-receiving portion that has a substantially flat surface via which the pressure-receiving portion is applied with force toward the welded portion when the welded portion is welded to the outer wall surface of the sub-tank.

According to another aspect of the present invention, a jet pump is provided for supplying fuel from a fuel tank into a sub-tank, which is accommodated in the fuel tank. The jet pump includes a welded portion that is adapted to being welded to an outer wall surface of the sub-tank. The jet pump further includes a swirl portion that defines therein a swirl chamber. The jet pump further includes a jet nozzle for generating negative pressure by jetting swirl-flowing fuel passing through the swirl chamber so as to draw fuel from the fuel tank into the sub-tank. The jet pump further includes a pressure-receiving portion that defines a clearance with respect to the swirl portion. The pressure-receiving portion and the swirl portion extend from the welded portion in a substantially same direction. The pressure-receiving portion is applied with force toward the welded portion when the welded portion is welded to the outer wall surface of the sub-tank.

According to another aspect of the present invention, a method for welding a jet pump, which has a substantially cylindrical swirl portion for generating a swirl flow therein, to an outer surface of sub-tank accommodated in a fuel tank, includes fitting a welded portion of the jet pump to the outer surface of the sub-tank. The method further includes bringing an ultrasonic generator into contact with a pressure-receiving surface of a pressure-receiving portion, which defines a clearance with respect to the substantially cylindrical swirl portion, so as to apply force to the jet pump toward the outer surface of the sub-tank via the pressure-receiving portion and the welded portion. The method further includes applying acoustic energy from the ultrasonic generator to the welded portion via the pressure-receiving portion so as to weld the welded portion to the outer surface of sub-tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
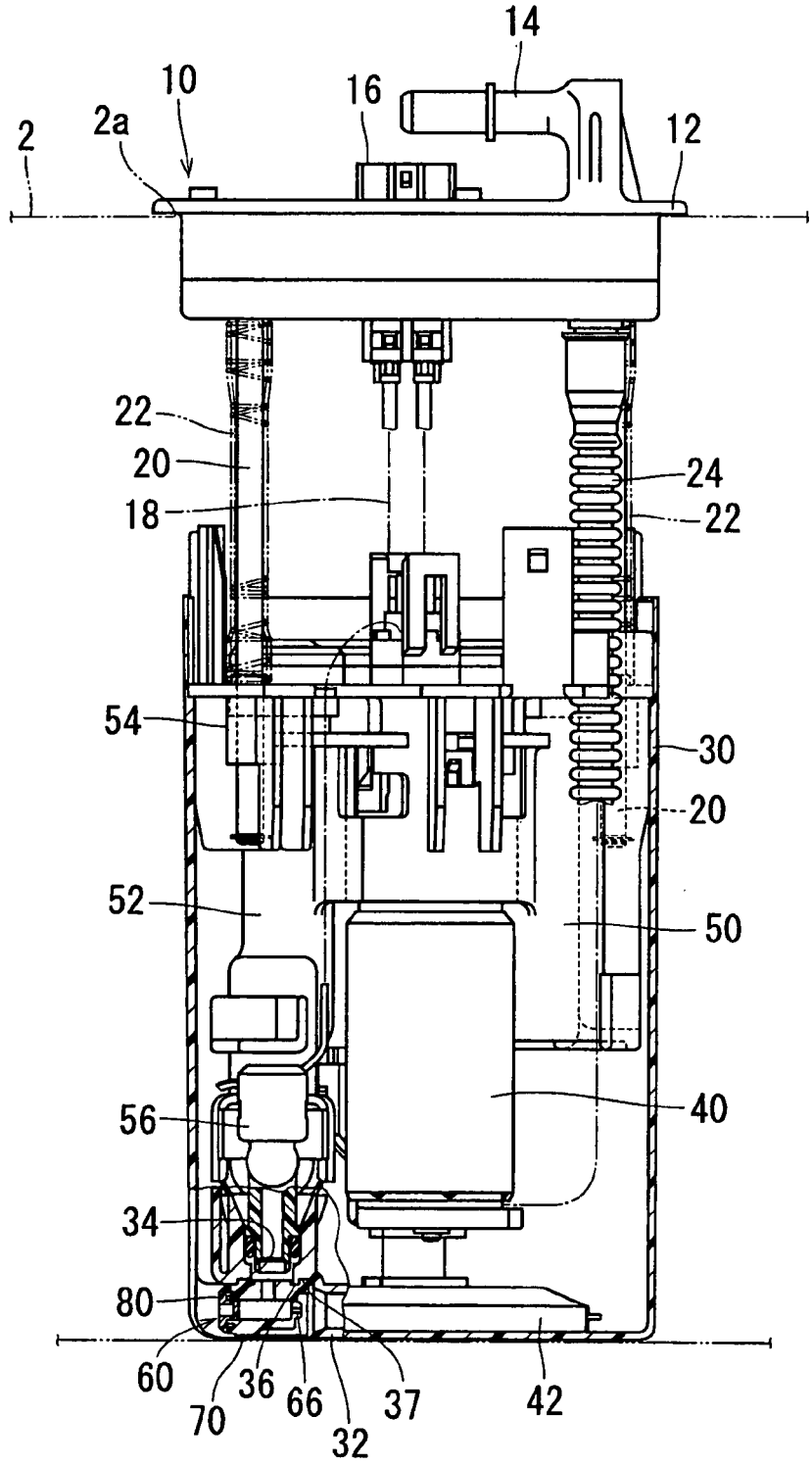
FIG. 1 is a longitudinal partially sectional view showing a fuel feed apparatus.

As shown in FIG. 1, a fuel feed apparatus 10 includes a lid member 12 that is formed of resin in a substantially disc-shape. The lid member 12 plugs an opening 2*a* of a fuel tank 2. The lid member 12 is provided with a fuel outlet pipe 14 and an electric connector 16. A fuel pump 40 pressurizes fuel, and supplies the pressurized fuel to the outside of the fuel tank 2 through the fuel outlet pipe 14. The fuel pump 40 is electrically connected with an unillustrated fuel meter via the electric connector 16 and a lead wire 18.

Each of metallic pipes 20 has one end press-inserted into the lid member 12 on the inner side of the fuel tank 2. Each of the metallic pipes 20 has the other end inserted into an inserted portion 54 provided to a filter case 52 of a fuel filter 50. Each of springs 22 has one end hooked to the lid member 12. Each of the springs 22 has the other end hooked to the filter case 52. The springs 22 bias the lid member 12 and a fuel filter 50 to separate from each other.

A sub-tank 30 is formed of resin such as polyacetal (POM). The sub-tank 30 is accommodated in the fuel tank 2. The sub-tank 30 receives the fuel pump 40, a suction filter 42, and the fuel filer 50. The bottom portion of the sub-tank 30 is formed of resin integrally with a throat pipe 32 through which a jet pump 60 transfers fuel from the fuel tank 2 into the sub-tank 30. The bottom portion of the sub-tank 30 is provided with the jet pump 60. The bottom portion of the sub-tank 30 has a supply port 34 through which surplus fuel, which is exhausted from an unillustrated pressure regulator, is supplied to the jet pump 60.

The fuel pump 40 is, for example, a turbine pump having an impeller rotated using a brush motor or a brushless motor. The fuel pump 40 is snap-fitted to the filter case 52 of the fuel filter 50. The suction filter 42 removes foreign matters contained in fuel drawn from the sub-tank 30 into the fuel pump 40. The fuel pump 40 discharges fuel, and the discharged fuel flows out of the fuel tank 2 after passing through the fuel filter 50, the bellows pipe 24, and the fuel outlet pipe 14.

The fuel filter 50 has a filter element accommodated in the filter case 52. The filter element of the fuel filter 50 removes foreign matters contained in fuel discharged from the fuel pump 40. The filter case 52 of the fuel filter 50 is snap-fitted to an upper portion of the sub-tank 30. The filter case 52 includes a holder 56 for supporting the pressure regulator. The pressure regulator controls pressure of fuel discharged from the fuel pump 40.

Figure 2A:
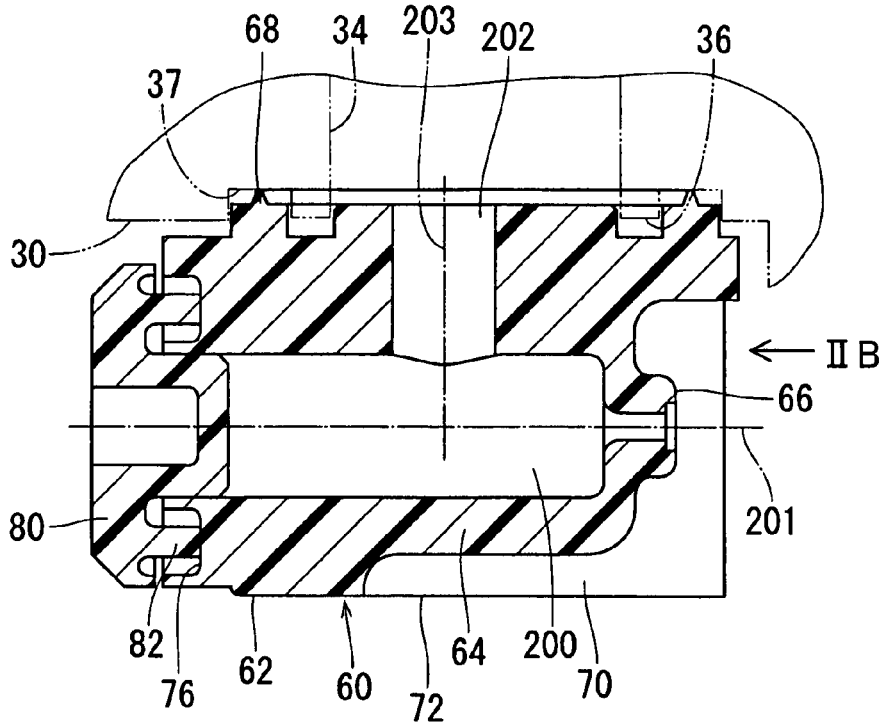
FIG. 2A is a sectional view showing a jet pump of the fuel feed apparatus.
Figure 2B:
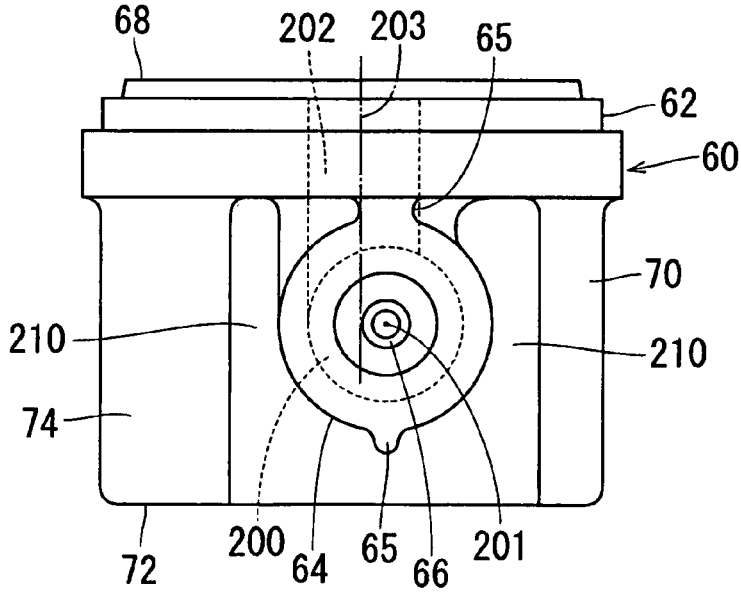
FIG. 2B is a view when being viewed from the arrow IIB in FIG. 2A.
Figure 3:
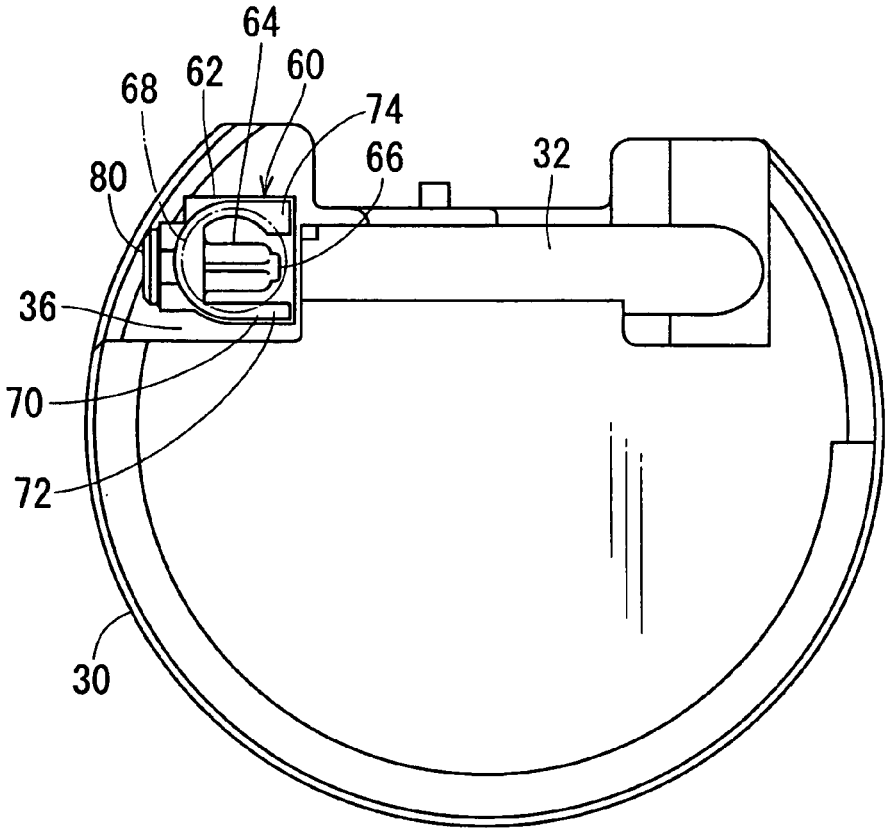
FIG. 3 is a bottom view of a sub-tank of the fuel feed apparatus.

The jet pump 60 is formed of resin such as polyacetal (POM), which is the same as the material of the sub-tank 30. As shown in FIGS. 1, 3, the jet pump 60 is welded to a connecting surface 36. The connecting surface 36 is defined around the supply port 34 in the outer wall surface of the bottom portion of the sub-tank 30. Each of FIGS. 2A, 2B depicts the jet pump 60 before being welded to the sub-tank 30. The jet pump 60 is constructed of a pump body 62 and a plug 80. The plug 80 blocks one end of the pump body 62 on the opposite side of a jet nozzle 66. The plug 80 is welded to the pump body 62.

The pump body 62 has a swirl portion 64 that is in a substantially cylindrical shape extending along the connecting surface 36. The swirl portion 64 defines a swirl chamber 200 therein. Ribs 65 are provided to the swirl portion 64 for enhancing mechanical strength of the swirl portion 64. One of the ribs 65 is radially opposite to the other of the ribs 65 with respect to the swirl portion 64. The swirl chamber 200 has one end provided with the jet nozzle 66. The swirl chamber 200 has the other end blocked with the plug 80. A fuel passage 202 communicates with the swirl chamber 200. The pressure regulator exhausts surplus fuel, and the surplus fuel is supplied from the supply port 34 into the swirl chamber 200 through the fuel passage 202, in a condition where the jet pump 60 is welded to the sub-tank 30. The jet pump 60 has a welded protrusion 68 serving as a welded portion with respect to the sub-tank 30. The welded protrusion 68 is in a substantially annular shape extending around the fuel passage 202. The welded protrusion 68 projects toward the sub-tank 30. The welded protrusion 68 is urged onto the bottom portion of an annular groove 37 formed around the supply port 34 of the sub-tank 30 when the jet pump 60 is welded to the sub-tank 30.

The swirl chamber 200 has a passage axis 201. The fuel passage 202 has a passage axis 203. The passage axis 201 is twisted relative to the passage axis 203. The diameter of the swirl chamber 200 is greater than the diameter of the fuel passage 202. In this structure, surplus fuel, which is exhausted from the pressure regulator, flows from the supply port 34 into the swirl chamber 200 through the fuel passage 202, so that the fuel flowing into the swirl chamber 200 generates swirl flow in the swirl chamber 200. Thus, the jet pump 60 jets the swirl-flowing fuel from the swirl chamber 200 through the jet nozzle 66, thereby generating negative pressure around the jet nozzle 66. Thus, the jet pump 60 draws fuel from the fuel tank 2 utilizing the negative pressure. The fuel drawn from the fuel tank 2 is supplied into the sub-tank 30 through the throat pipe 32 together with the fuel jetted through the jet nozzle 66. The swirl-flowing fuel jetted from the jet nozzle 66 uniformly diffuses in the throat pipe 32 to form a liquid film. For example, fuel may not exist around the jet nozzle 66 in a condition where the vehicle runs on a slope or the vehicle corners. Even in these conditions, the swirl-flowing fuel jetted from the jet nozzle 66 forms the liquid film, so that the liquid film serves as a liquid seal for restricting fuel in the sub-tank 30 from flowing out of the sub-tank 30 through the throat pipe 32.

Figure 4:
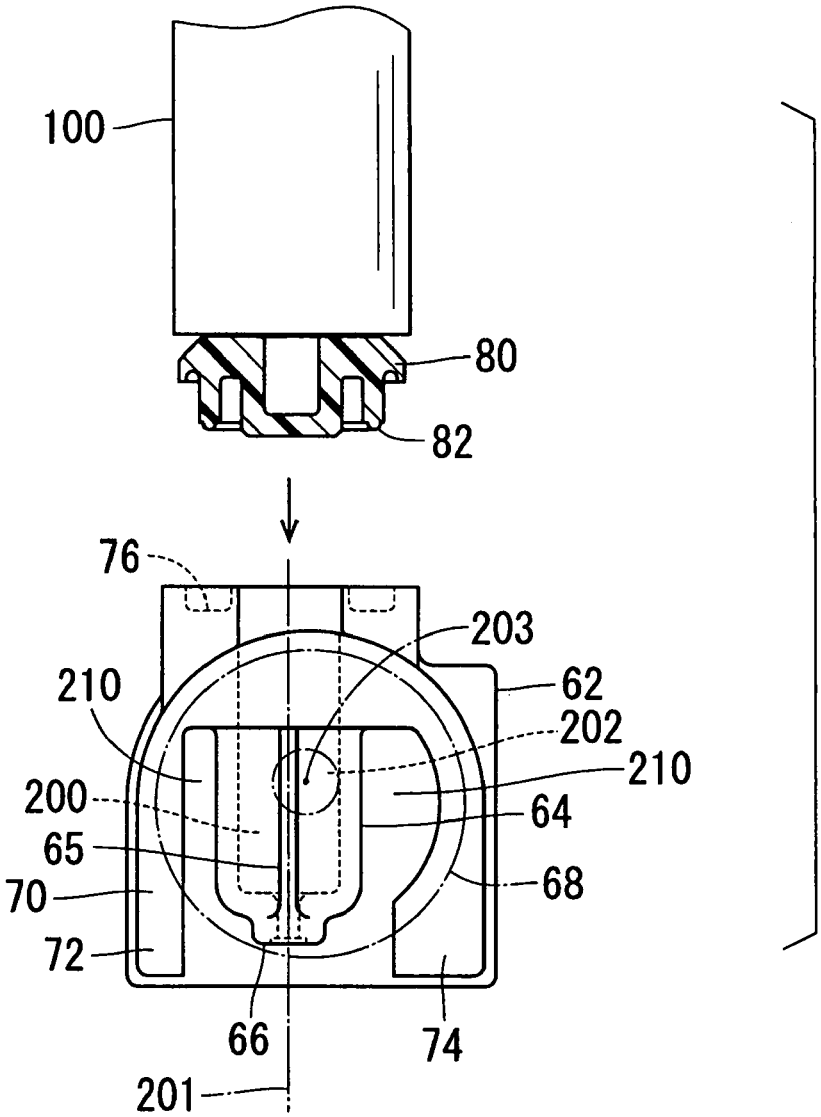
FIG. 4 is a schematic view showing a pump body being welded to a plug of the fuel feed apparatus.

The jet pump 60 has a pressure-receiving portion 70 that defines a wall extending from the welded protrusion 68 to the opposite side of the sub-tank 30. That is, the pressure-receiving portion 70 extends from the welded protrusion 68 in the direction to distant from the sub-tank 30. The pressure-receiving portion 70 defines a clearance 210 with respect to the swirl portion 64. The pressure-receiving portion 70 is at least partially located in a projected area of the welded protrusion 68 when being viewed from the sub-tank 30. In FIGS. 3, 4, the chain line denoted by numeral reference 68 depicts the position of the welded protrusion 68 when being viewed from a pressure-receiving surface 72 of the pressure-receiving portion 70. As referred to FIGS. 2A, 2B, the pressure-receiving surface 72 of the pressure-receiving portion 70 is located on the opposite side of the sub-tank 30 with respect to the welded protrusion 68. The pressure-receiving surface 72 is substantially flat. The pressure-receiving portion 70 is in a substantially U-shape, such that the pressure-receiving portion 70 is disconnected in the vicinity of the jet nozzle 66. The pressure-receiving portion 70, which is disconnected in the vicinity of the jet nozzle 66, has one side defining a disconnected portion 74. The thickness of the disconnected portion 74 is greater than the thickness of the other portion of the pressure-receiving portion 70, so that the disconnected portion 74 has rigidity greater than the rigidity of the other portion of the pressure-receiving portion 70.

As referred to FIG. 2B, both the pressure-receiving portion 70 and the swirl portion 64 extend from the welded portion 68 in a substantially same direction.

As follows, a method, for welding the pump body 62 to the plug 80 for constructing the jet pump 60, and a method for welding the jet pump 60 to the sub-tank 30 are described.

FIG. 4 depicts a condition where an ultrasonic horn 100 applies force to the plug 80 directed to the pump body 62 in a condition where the ultrasonic horn 100 is connected to the plug 80, for showing the shape of a welded portion 82 of the plug 80. Actually, the ultrasonic horn 100 applies force to the plug 80 so as to urge the plug 80 onto the pump body 62 in a condition where the welded portion 82 of the plug 80 is fitted to an annular groove 76 formed in the pump body 62 on the opposite side of the jet nozzle 66.

The ultrasonic horn 100 generates ultrasonic at a frequency greater than 20 kHz, for example, while ultrasonic horn 100 applies force to the plug 80 so as to urge the plug 80 onto the pump body 62. Energy of the ultrasonic oscillates the tip end of the welded portion 82 of the plug 80, so that the boundary between the welded portion 82 and the annular groove 76 cause friction, thereby generating heat between the welded portion 82 and the annular groove 76. Thus, the boundary welds, so that the welded portion 82 is welded to the annular groove 76. Thus, the plug 80 is welded to the pump body 62, so that the end of the swirl chamber 200 on the opposite side of the jet nozzle 66 is blocked. As referred to FIG. 4, the plug 80 is welded to the pump body 62, so that the jet pump 60 shown in FIGS. 2A, 2B is constructed.

Figure 5:
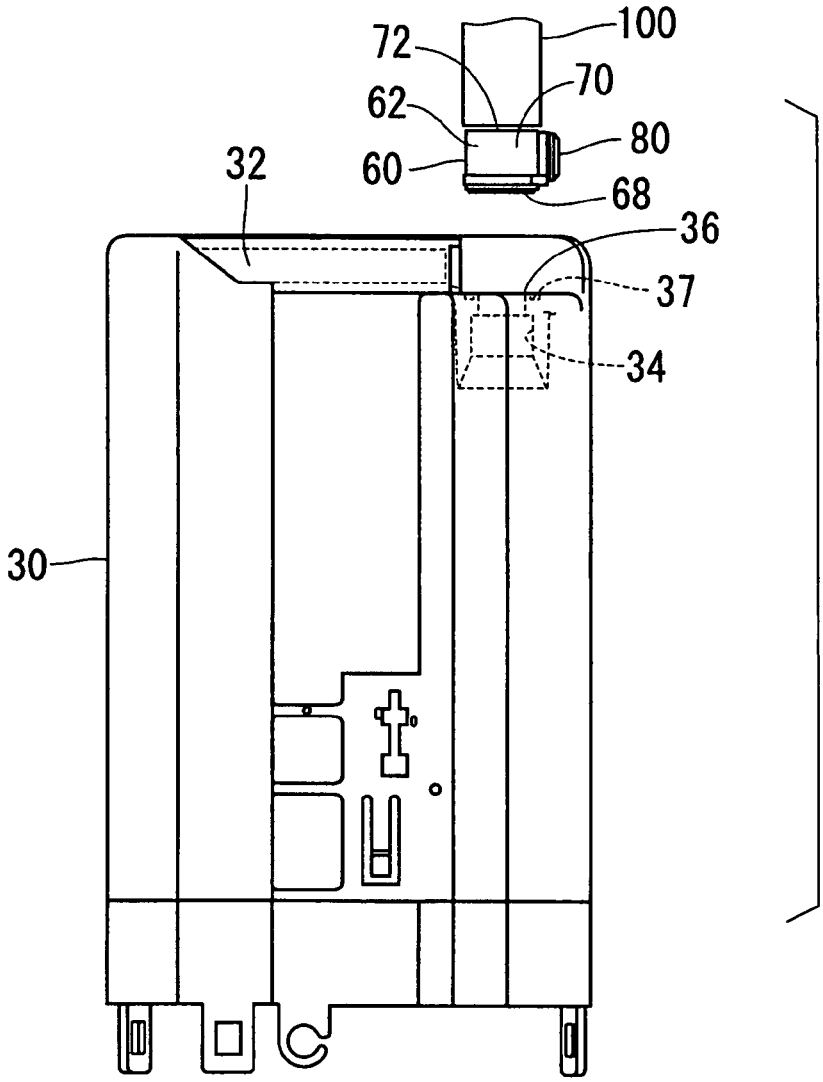
FIG. 5 is a schematic view showing the sub-tank being welded to the jet pump.

Similarly to FIG. 4, FIG. 5 depicts a condition where the ultrasonic horn 100 applies force to the jet pump 60 directed to the sub-tank 30 in a condition where the ultrasonic horn 100 is connected to the plug 80. Actually, the ultrasonic horn 100 applies force to the jet pump 60 so as to urge the jet pump 60 toward the sub-tank 30 in a condition where the welded protrusion 68 of the jet pump 60 is fitted to the annular groove 37 formed around the supply port 34 of the sub-tank 30.

The ultrasonic horn 100 makes contact with the pressure-receiving surface 72 of the pressure-receiving portion 70 of the jet pump 60 so as to apply force to the pressure-receiving portion 70. The pressure-receiving portion 70 defines the clearance 210 with respect to the swirl portion 64, which is in the substantially cylindrical shape. Therefore, the force applied from the ultrasonic horn 100 to the pressure-receiving portion 70 is not directly applied to the swirl portion 64. Thus, the swirl portion 64 can be protected from deformation caused by being applied with the force directly from the ultrasonic horn 100.

In addition, the pressure-receiving portion 70, via which the jet pump 60 is applied with force when being welded, is formed separately from the swirl portion 64. The pressure-receiving surface 72 of the pressure-receiving portion 70 is substantially flat. Therefore, the ultrasonic horn 100 is capable of readily applying force to the jet pump 60.

The pressure-receiving surface 72 of the pressure-receiving portion 70 is substantially flat. Therefore, force is uniformly applied circumferentially from the ultrasonic horn 100 to the pressure-receiving portion 70, so that the force is further uniformly applied circumferentially from the pressure-receiving portion 70 to the substantially annular welded protrusion 68. Furthermore, the ultrasonic horn 100 applies acoustic energy uniformly from the pressure-receiving portion 70 circumferentially to the substantially annular welded protrusion 68. Thus, the welded protrusion 68 causes circumferentially uniform oscillation. Furthermore, the pressure-receiving portion 70, which is disconnected in the vicinity of the jet nozzle 66, has the one side defining the disconnected portion 74. The disconnected portion 74 is large in thickness, and has high rigidity. Therefore, the ultrasonic horn 100 is capable of applying force and acoustic energy sufficiently to a portion of the welded protrusion 68, which corresponds to the portion, in which the pressure-receiving portion 70 is disconnected and the pressure-receiving portion 70 is not formed. Thus, the welded protrusion 68 can be uniformly welded circumferentially when the jet pump 60 is welded. Consequently, the jet pump 60 can be restricted from tilting when being welded. Furthermore, the jet pump 60 and the sub-tank 30 can be restricted from causing insufficient welding partially therebetween.

In the above structure, the pressure-receiving portion 70 at least partially exists in the projected area of the welded protrusion 68. This projected area of the welded protrusion 68 is focused, i.e., thrown from the welded protrusion 68 in the direction to distant from the sub-tank 30. In this stricture, the welded protrusion 68 is at least partially located on a straight line through which the force is applied to the pressure-receiving portion 70 toward the sub-tank 30 when the jet pump 60 is welded. Thus, declination of force applied from the pressure-receiving portion 70 to the welded protrusion 68 can be reduced.

In the above structure, when the jet pump 60 is welded to the sub-tank 30, the swirl portion 64 is not directly applied with force from the ultrasonic horn 100. Therefore, the swirl portion 64 can be restricted from being largely deformed in the welding of the jet pump 60, so that the shape of the swirl chamber 200 defined in the swirl portion 64 can be maintained.

In the above structure, the pressure-receiving portion 70 is disconnected in the vicinity of the jet nozzle 66, so that the pressure-receiving portion 70 may not disturb fuel flow when the jet nozzle 66 jets swirling fuel to draw fuel from the fuel tank 2. That is, the disconnected portion 74 defines a port through which fuel is drawn by the jet pump 60.

Other Embodiment

The pressure-receiving surface of the pressure-receiving portion is not limited to the substantially flat surface, as long as:

the pressure-receiving portion defines the clearance 210 with respect to the swirl portion 64; and the pressure-receiving portion extends from the welded protrusion 68 in the direction to distant from the sub-tank 30. The pressure-receiving surface may be a curbed surface.

When the pressure-receiving surface, via which the jet pump is applied with force toward the sub-tank, is substantially flat, the pressure-receiving portion need not define the clearance with respect to the swirl portion, and the pressure-receiving portion may have a pressure-receiving flat surface that surrounds the swirl portion 64 on the opposite side of the welded protrusion 68.

A pressure-receiving portion may be provided to the swirl portion 64 on the side to which pressure is applied when being welded, such that the pressure-receiving portion define a clearance relative to the swirl portion 64 to surround the swirl portion 64.

Various modifications and alternations may be diversely made to the above embodiments without departing from the spirit of the present invention.

What is claimed is:

1. A jet pump for supplying fuel from a fuel tank into a sub-tank, which is accommodated in the fuel tank, the jet pump comprising:

a welded portion that is adapted to being welded to an outer wall surface of the sub-tank;

a swirl portion that defines therein a swirl chamber;

a jet nozzle for generating negative pressure by jetting swirl-flowing fuel passing through the swirl chamber so as to draw fuel from the fuel tank into the sub-tank; and a pressure-receiving portion that defines a clearance with respect to the swirl portion, wherein the pressure-receiving portion extends from the welded portion in a direction to distant from the sub-tank, and the pressure-receiving portion is applied with force toward the welded portion when the welded portion is welded to the outer wall surface of the sub-tank.

2. The jet pump according to claim 1, wherein the pressure-receiving portion has a pressure-receiving surface via which the pressure-receiving portion is applied with the force, and the pressure-receiving surface is substantially flat.

3. The jet pump according to claim 1, wherein the pressure-receiving portion is at least partially located in a projected area of the welded portion, and the projected area is oriented in a direction distant from the sub-tank.

4. The jet pump according to claim 1, wherein the pressure-receiving portion is disconnected in the vicinity of the jet nozzle.

5. The jet pump according to claim 4, wherein the pressure-receiving portion has a disconnected portion, in which the pressure-receiving portion is disconnected in the vicinity of the jet nozzle, and the disconnected portion has a thickness greater than a thickness of a portion of the pressure-receiving portion other than the disconnected portion.

6. A fuel feed apparatus comprising:

the sub-tank; and the jet pump according to claim 1, wherein the welded portion of the jet pump is welded to the outer surface of the bottom wall of the sub-tank.

7. A method for welding the jet pump according to claim 1 to the sub-tank, the method comprising:

welding the jet pump to the sub-tank while the welded portion is applied with force toward the sub-tank using an ultrasonic generator.

8. A jet pump for supplying fuel from a fuel tank, which accommodates a sub-tank, into the sub-tank, the jet pump comprising:

a welded portion that is adapted to being welded to an outer wall surface of the sub-tank;

a swirl portion that defines a swirl chamber;

a jet nozzle for generating negative pressure by jetting swirl-flowing fuel passing through the swirl chamber so as to draw fuel from the fuel tank into the sub-tank; and a pressure-receiving portion that has a substantially flat surface via which the pressure-receiving portion is applied with force toward the welded portion when the welded portion is welded to the outer wall surface of the sub-tank.

9. The jet pump according to claim 8, wherein the pressure-receiving portion is at least partially located in a projected area of the welded portion, and the projected area is oriented in a direction distant from the sub-tank.

10. The jet pump according to claim 8, wherein the pressure-receiving portion is disconnected in the vicinity of the jet nozzle.

11. The jet pump according to claim 10, wherein the pressure-receiving portion has a disconnected portion, in which the pressure-receiving portion is disconnected in the vicinity of the jet nozzle, and the disconnected portion has a thickness greater than a thickness of a portion of the pressure-receiving portion other than the disconnected portion.

12. A fuel feed apparatus comprising:

the sub-tank; and the jet pump according to claim 8, wherein the welded portion of the jet pump is welded to the outer surface of the bottom wall of the sub-tank.

13. A method for welding the jet pump according to claim 8 to the sub-tank, the method comprising:

welding the jet pump to the sub-tank while the welded portion is applied with force toward the sub-tank using an ultrasonic generator.

14. A jet pump for supplying fuel from a fuel tank into a sub-tank, which is accommodated in the fuel tank, the jet pump comprising:

a welded portion that is adapted to being welded to an outer wall surface of the sub-tank;

a swirl portion that defines therein a swirl chamber;

a jet nozzle for generating negative pressure by jetting swirl-flowing fuel passing through the swirl chamber so as to draw fuel from the fuel tank into the sub-tank; and a pressure-receiving portion that defines a clearance with respect to the swirl portion, wherein the pressure-receiving portion and the swirl portion extend from the welded portion in a substantially same direction, and the pressure-receiving portion is applied with force toward the welded portion when the welded portion is welded to the outer wall surface of the sub-tank.

15. A method for welding a jet pump, which has a substantially cylindrical swirl portion for generating a swirl flow therein, to an outer surface of sub-tank accommodated in a fuel tank, the method comprising:

fitting a welded portion of the jet pump to the outer surface of the sub-tank;

bringing an ultrasonic generator into contact with a pressure-receiving surface of a pressure-receiving portion, which defines a clearance with respect to the substantially cylindrical swirl portion, so as to apply force to the jet pump toward the outer surface of the sub-tank via the pressure-receiving portion and the welded portion; and applying acoustic energy from the ultrasonic generator to the welded portion via the pressure-receiving portion so as to weld the welded portion to the outer surface of sub-tank.

16. The method according to claim 15, wherein the pressure-receiving surface is substantially flat.

* * * * *